US005738592A

United States Patent [19]

Saunders

[11] Patent Number: 5,738,592

[45] Date of Patent: Apr. 14, 1998

[54] INTERCHANGEABLE AND ROTATABLE FINGER INSERT FOR A BOWLING BALL

[76] Inventor: James P. Saunders, 17 Carraige Run, Lincoln University, Pa. 19352

[21] Appl. No.: 786,272

[22] Filed: Jan. 22, 1997

[51] Int. Cl.[6] ..... A63B 37/00

[52] U.S. Cl. ..... 473/130; 473/129

[58] Field of Search ..... 473/129, 130

[56] References Cited

U.S. PATENT DOCUMENTS 3,102,725 9/1963 Jarus ..... 473/130

5,118,106 6/1992 Goldman ..... 473/129

*Primary Examiner*—William M. Pierce

*Attorney, Agent, or Firm*—Ratner & Prestia

[57] ABSTRACT

A finger insert for a bowling ball which includes a socket for accepting the insert. The insert comprises an outer sleeve and an inner sleeve, wherein the outer sleeve has an outer diameter sixed to be fixedly inserted into the socket, and the inner sleeve can be rotatably and removably mounted within the outer sleeve. The inner sleeve has an interior which is sized to contain a bowler's finger.

18 Claims, 6 Drawing Sheets

INTERCHANGEABLE AND ROTATABLE FINGER INSERT FOR A BOWLING BALL

BACKGROUND OF THE INVENTION

1. Field of the Invention

This invention relates to an interchangeable finger insert for a bowling ball. More particularly, the invention relates to an interchangeable thumb insert for a bowling ball adapted to rotate with the thumb within the ball.

2. Description of Related Art

Those who bowl, whether they are amateurs or professionals, realize that the finger holes are just as important to good bowling as is the size and weight of the ball. In particular, the size, shape and pitch of the thumb hole in the bowling ball are vital to accurate and consistent rolling of the bowling ball. Generally, the thumb hole is formed by drilling a hole directly into the ball. The drilling process is quite particular in that the thumb hole is drilled into the ball for a predetermined distance, having a particular diameter and angled at a particular "pitch," such as forward, backward, left or right. Not every bowler has the same size thumb or is comfortable with the same pitch of the thumb hole. As such, manufacturers make a great variety of bowling balls with differently sized and pitched thumb holes.

However, as they stand now, there remain problems with the thumb hole, including a general lack of comfort and frequent injury to the thumb. Recently, in order to improve the comfort of the thumb hole and reduce the chance of injury, instead of merely drilling a hole into the ball and leaving it at that, ball manufacturers have designed thumb inserts which can be permanently inserted within the thumb hole. These thumb inserts are generally made of, for instance, soft polyvinyl chloride (PVC), which is softer and much more comfortable than the ball material itself.

Although the softer thumb inserts do solve some of the comfort problems, there are still additional problems that remain. In particular, throughout each bowling game, a bowler's thumb will naturally swell and shrink due to the friction and torque stresses resulting from the bowling motion. Thus, when the thumb swells, the thumb insert becomes too tight for the bowler's thumb, and vice versa as the swelling reduces. As a result of this, the bowler will release the ball inconsistently, resulting in an inconsistent game and an increase in injuries. In order to overcome this problem, bowlers will use several balls, each having different sized thumb holes or inserts, sized to conform to the expected changes in thumb size. However, it is expensive to purchase multiple balls and inconvenient to carry several balls at a time.

Somewhat related to this problem, bowlers also face the prospective chance of injury to the thumb due to the natural rotation of the ball when it is thrown. Each time a bowler throws a bowling ball, there is a certain degree of rotation of the ball. As a result, there is a resulting friction within the thumb hole between the bowler's thumb and the thumb hole. This friction can result in, at least, blisters or tears in the skin, and at worst, can actually twist or sprain the thumb.

As such, there is a need for a thumb insert which is replaceable with different sized inserts and which is capable of rotating with the thumb while contained within the ball.

SUMMARY OF THE INVENTION

The present invention relates to a finger insert for a bowling ball having a socket for accepting said insert, the insert comprising:

an outer sleeve having an outer diameter sized to be fixedly insertable in said socket; and an inner sleeve removably mounted in said outer sleeve, said inner sleeve having an interior sized to contain a bowler's finger, wherein the sleeve may also be rotatably mounted therein.

BRIEF DESCRIPTION OF THE DRAWINGS

The invention can be more fully understood from the following description thereof in connection with the accompanying drawings described as follows.

DESCRIPTION OF THE PREFERRED EMBODIMENT(S)

Figure 1:
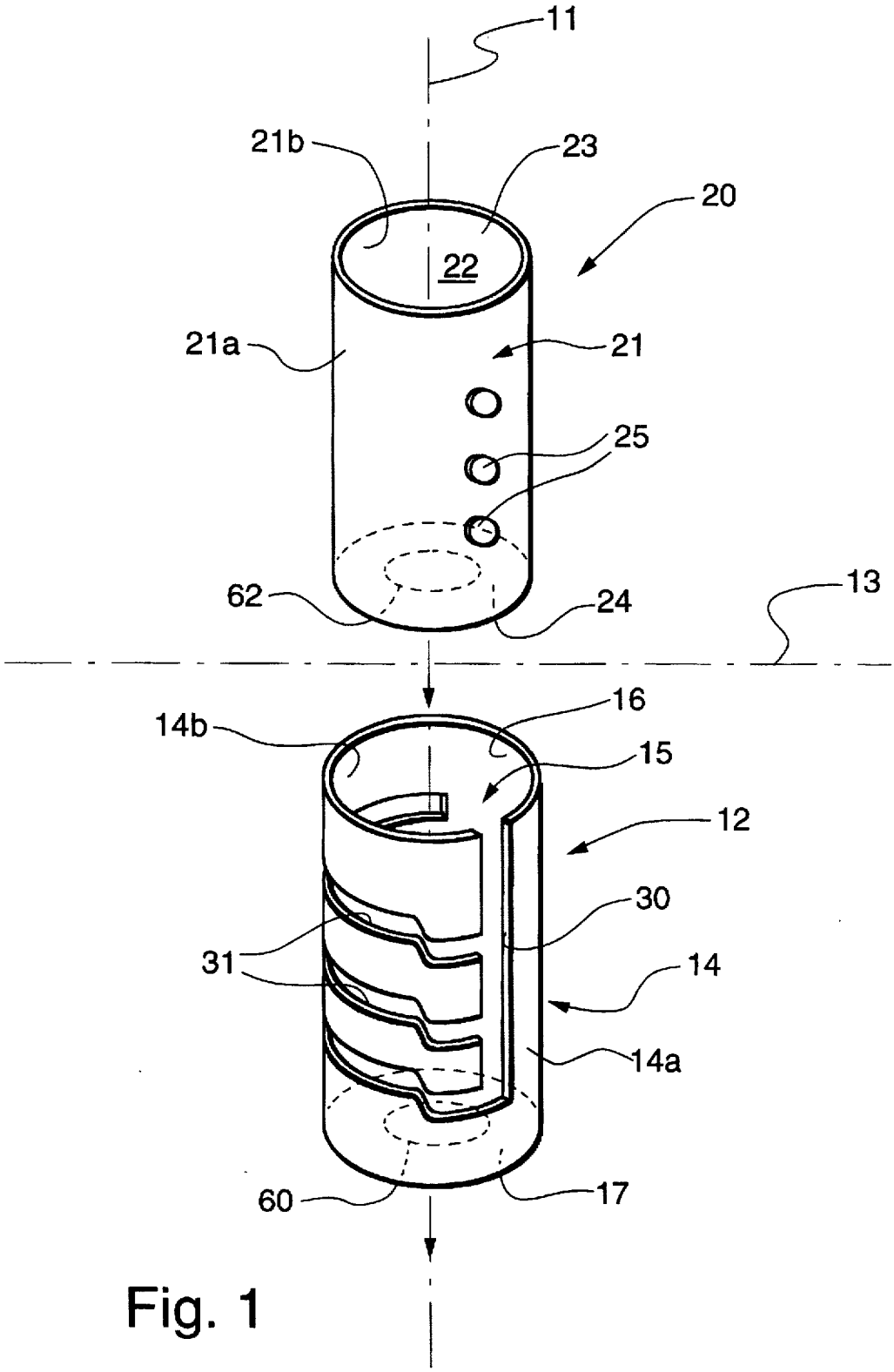
FIG. 1 is a schematic representation of an exploded view of one embodiment of the present device.

Throughout the following detailed description, similar reference characters refer to similar elements in all figures of the drawings.

The finger insert of the invention comprises two parts as can be seen in the exploded view shown in FIG. 1. In particular, the thumb insert comprises an outer sleeve 12 and an inner sleeve 20. Inner sleeve 20 is adapted to rotatably and removably fit within outer sleeve 12. Outer sleeve 12 is adapted to fit into the bowling ball 50 itself. Both the outer and inner sleeves 12, 20 are preferably made from hard polyvinyl chloride (PVC), but can be made from any other plastic or plastic composite which can stand up to the torque stresses of the throwing of the ball 50 as well as the impact force resulting from the ball 50 hitting the bowling lane. Some examples include pure urethane, polyurethane, ABS plastic, pure acrylic, and the like.

Outer sleeve 12 is preferably formed in the shape of a cylindrical tube, as depicted in the figures, comprising a wall 14 having an outer wall surface 14*a* and an inner wall surface 14*b*, an open top 16, a bottom 17, and a hollow interior 15.

Figure 2:
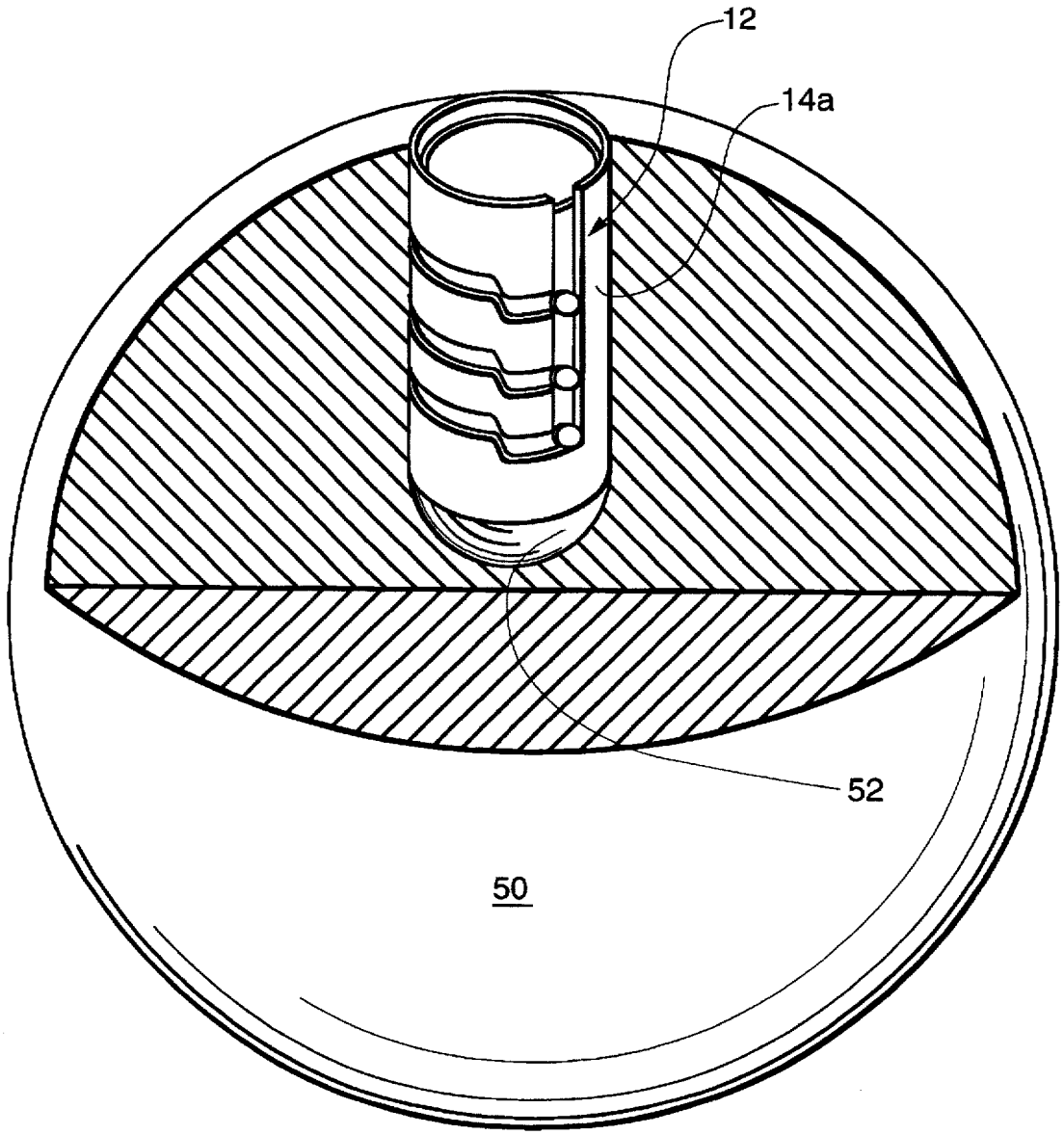
FIG. 2 is a schematic representation of an elevation view of one embodiment of the present device showing the device within a bowling ball.

Although it is preferred that outer sleeve 12 be shaped as a cylinder, it is only essential that the interior 15 of sleeve 12 be cylindrical to allow for rotation of inner sleeve 20 therein. Outer sleeve 12 is preferably permanently attached within the bowling ball. In particular, as shown in FIG. 2, a socket 52 is formed within the bowling ball 50, and outer sleeve 12 is permanently fitted within the hole in the ball via an adhesive appropriate to the substrate, such as Superglue™. The socket 52 preferably has the same shape as the outer wall surface 14*a* of outer sleeve 12. This shape can be any shape, so long as outer sleeve 12 can be fixedly fitted within socket 52.

The outer wall surface 14*a* of outer sleeve 12 forms an outer diameter. This diameter can be any size so long as the sleeve 12 can fit into the corresponding socket 52. It is preferable that this outer surface diameter range from 1.0 to 1.75 inches, and it is even more preferable that this diameter be 1.375 inches. Similarly, inner wall surface 14*b* forms an inner diameter. This diameter can be any size so long as it is sized to contain the inner sleeve 20. It is preferred that the inner diameter range from 0.75 to 1.5 inches, and more preferably, 1.197 inches.

The thickness of wall 14 of outer sleeve 12 (i.e., the distance between outer surface 14*a* and inner surface 14*b*) is not critical so long as the outer sleeve 12 both fits within its corresponding socket 52 in the bowling ball 50 and the interior 15 has a diameter which will allow inner sleeve 20 to fit properly therein. It is preferred that the thickness of the wall range from 0.1 to 0.25 inches, and it is even more preferred that the thickness of the wall 14 be 0.178 inches.

The length of outer sleeve 12 must be such that it can contain an inner sleeve 20 of any desirable length. Generally, a person's thumb can only be so long. As such, the outer sleeve 12 should have a length which is long enough to accommodate the longest expected thumb size.

Some manufacturers produce a bowling ball 50 having a ceramic core. Due to the composition of ceramic, a socket cannot be drilled into the core. As such, there is a maximum distance of 2.5 inches between the core and the shell of the ball 50 into which a socket 52 can be drilled. Accordingly, for such an embodiment, the outer sleeve 12 is limited to a length of 2.5 inches or less.

Carved through the wall 14 of outer sleeve 12 are at least one longitudinal channel 30 and one lateral channel 31. The channels 30, 31 can best be seen in FIGS. 1, 2 and 4. In the preferred embodiment, channels 30 and 31 comprise grooves cut completely through wall 14 of outer sleeve 12. However, the channels 30 and 31 can be grooves that are cut a predetermined distance into the inner surface 14*b* of wall 14 but do not extend through the outer wall surface 14*a*. Such an embodiment provides greater structural stability to the outer sleeve 12. Such added stability can also be provided for the embodiment wherein the channels 30, 31 are cut completely through the wall 14 by surrounding the outer wall surface 14*a* with a shell or coating of the same or similar material as that used for the outer sleeve 12 itself.

Longitudinal channel 30 preferably begins at the open top 16 of sleeve 12 and extends longitudinally in the direction of axis 11 toward the bottom 17 of the sleeve. It is preferred that longitudinal channel 30 end prior to reaching the bottom 17 of the sleeve. It is also preferable that longitudinal channel 30 extend a distance greater than 50% of the length of outer sleeve 12. In a preferred embodiment, channel 30 extends a distance of 1.75 inches. Channel 30 can have any width so long as the width can slidably contain tips 25 of inner sleeve 20 as described below. The preferred width of channel 30 should range from 0.125 to 0.5 inches, and it is more preferable that the channel 30 have a width of 0.25 inch. If channel 30 does not extend completely through wall 14, then it should extend to a depth of 0.0625 to 0.25 inch, and more preferably, 0.125 inch into the inner surface 14*b* of wall 14.

Lateral channel 31 extends perpendicularly from longitudinal channel 30 in the direction of axis 13 around the perimeter of wall 14. Lateral channel 31 begins from longitudinal channel 30 and extends for a predetermined distance around the perimeter of wall 14, but does not extend completely 360° around the perimeter. It is preferred that lateral channel 31 extend approximately 270° around the perimeter of wall 14, although the distance which lateral channel 31 extends can be varied depending upon on how much rotation of inner sleeve 20 is desired. The width and depth of channel 31 is preferably equivalent to the width and depth of channel 30.

It is preferred that there be more than one lateral channel 31 extending from longitudinal channel 30 in order to make the rotating insert more stable. In addition, if more than one lateral channel 31 is provided, it has been found that a separation distance of 1.25 inch between each lateral channel 31 provides the best structural strength for the outer sleeve 12. However, this distance can be altered to whatever one would like.

Inner sleeve 20 is also preferably formed in the shape of a cylindrical tube comprising a wall 21 having an outer wall surface 21*a* and an inner wall surface 21*b*, an open top 23, a bottom 24 and an interior 22. Inner sleeve 20 is adapted to slidably and rotatably fit within the interior 15 of outer sleeve 12.

The outer wall surface 21*a* of inner sleeve 20 forms an outer diameter. This diameter can be any size so long as inner sleeve 20 can fit slidably into outer sleeve 12. In other words, the outer diameter of inner sleeve 20 should be slightly smaller than the inner diameter of outer sleeve 12. It is preferred that this outer surface diameter of inner sleeve 20 range from 0.75 to 1.75 inches, and it is even more preferred that this diameter be 1.192 inches. Similarly, inner wall surface 21*b* forms an inner diameter. This diameter can be any size and is sized to contain a person's finger, preferably the thumb. Typically, the inner diameter ranges from 0.5 to 1.5 inches, and is usually 1.125 inches.

The thickness of wall 21 of inner sleeve 20 (i.e., the distance between outer surface 21*a* and inner surface 21*b*) is not critical, but should be thick enough to provide the structural support needed for the tips 25 which attach the inner sleeve 20 to the outer sleeve 12 and hold it there throughout the throwing of the ball 50. It is preferred that the thickness of the wall range from 0.01 to 0.12 inches, and it is even more preferred that the thickness of the wall 21 be 0.062 inches.

As best seen in FIG. 1, disposed along a portion of the wall outer surface 21*a* of inner sleeve 20 is at least one tip 25 which is adapted to fit and ride within channels 30 and 31. It is preferred that there be more than one tip 25, and in fact, it is more preferred that the number of tips 25 correspond to the number of lateral channels 31 formed in outer sleeve 12. Tips 25 preferably extend a distance from wall outer surface 21*a* less than or equal to the thickness of wall 14 of outer sleeve 12 such that tips 25 do not protrude past the outer wall surface 14*a* of outer sleeve 12 when inner sleeve 20 is inserted therein. As such, in the embodiment described above where channels 30 and 31 are not cut entirely through wall 14 of sleeve 12, the distance channels 30 and 31 extend into inner wall surface 14*b* is preferably equivalent to the length of tips 25 with an approximate difference of 0.005 inch provided for clearance. It is preferred that the length of tips 25 be 0.178 inches.

Tips 25 are preferably cylindrical in shape, as shown in the figures, although tips 25 can have any shape, such as square, rectangular, or the like, so long as the shape permits the tips 25 to slidably ride within channels 30 and 31. It is, however, important to realize that prior to the release of the ball 50, the ball 50 is swung along an arc during which a great amount of force is exerted upon the tips 25 which are basically the only points which hold the ball to the user's hand via the inner sleeve 20. Therefore, the size and number of tips 25 provided must be such to resist deformation or even shearing of the tips 25 during use.

In a preferred embodiment (not shown), an extruded nylon thumb insert can be inserted within the interior 22 of inner sleeve 20 to improve the comfort of the insert. Any other soft material can be used in place of extruded nylon, such as soft PVC or the like.

Inner sleeve 20 is placed within the hollow interior of outer sleeve 12 to form the rotatable and removable thumb insert of the invention. As such, it is preferred that inner sleeve 20 be adapted to rotatably fit within outer sleeve 12. It is preferred that inner sleeve 20 fit snugly within outer sleeve 12, however, the fit must be such that inner sleeve 20 can smoothly rotate laterally within outer sleeve 12.

Channels 30 and 31 are provided in outer sleeve 12 for the dual purposes of allowing inner sleeve 20 to be removably inserted into outer sleeve 12 and, once inserted, allowing inner sleeve 20 to rotate within outer sleeve 12. In particular, without the longitudinal channel 30, inner sleeve 20 would not fit into outer sleeve 12 due to the protruding tips 25. Thus, longitudinal channel 30 allows tips 25 to slide therethrough when inner sleeve 12 is inserted and removed from outer sleeve 12.

Figure 3:
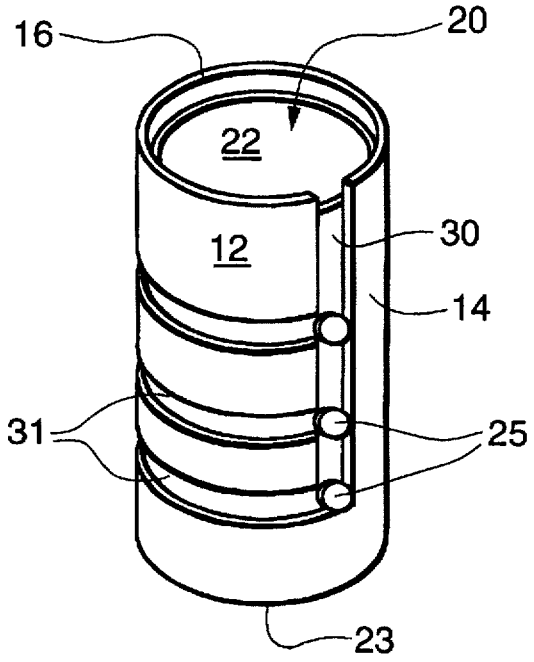
FIG. 3 is a schematic representation of an elevation view of an alternate embodiment of the present device.

Inner sleeve 20 is inserted into outer sleeve 12 by aligning tip 25 with longitudinal channel 30 and sliding inner sleeve 20 into outer sleeve 12 with tips 25 riding along channel 30. In the embodiment shown in FIG. 3, when inner sleeve 20 is inserted completely within outer sleeve 12, tips 25 are positioned at the intersection of longitudinal channel 30 and lateral channels 31. In this position, the inner sleeve 20 of the thumb insert can either be removed (i.e., to exchange for a different sized inner sleeve) or can be rotated within outer sleeve 12.

Inner sleeve 20 can be rotated because tips 25 move laterally through channels 31. It is preferred that inner sleeve 20 rotates, while outer sleeve 12 remains fixed within the bowling ball.

In a preferred embodiment shown in FIGS. 1, 2 and 4, outer sleeve 12 includes three lateral channels 31. In accordance, inner sleeve 20 includes three tips 25 corresponding to the three lateral channels 31 of outer sleeve 12. Tips 25 are positioned along the wall 21 of inner sleeve 20 in a line in the direction of axis 11. Tips 25 are disposed in such a line in order to slide together through longitudinal channel 30 when inner sleeve 20 is inserted and removed from outer sleeve 12.

The tips 25 are spaced from each other at distances corresponding to those which respective lateral channels 31 on outer sleeve 12 are spaced from each other so that tips 25 are aligned with the lateral channels 31 when inner sleeve 20 is completely inserted. It is preferable that the spacing be 1.25 inch for best structural strength, although the spacing need only be such that the three channels 31 and tips 25 fit onto the spaced allotted on the sleeves 12 and 20.

Figure 6:
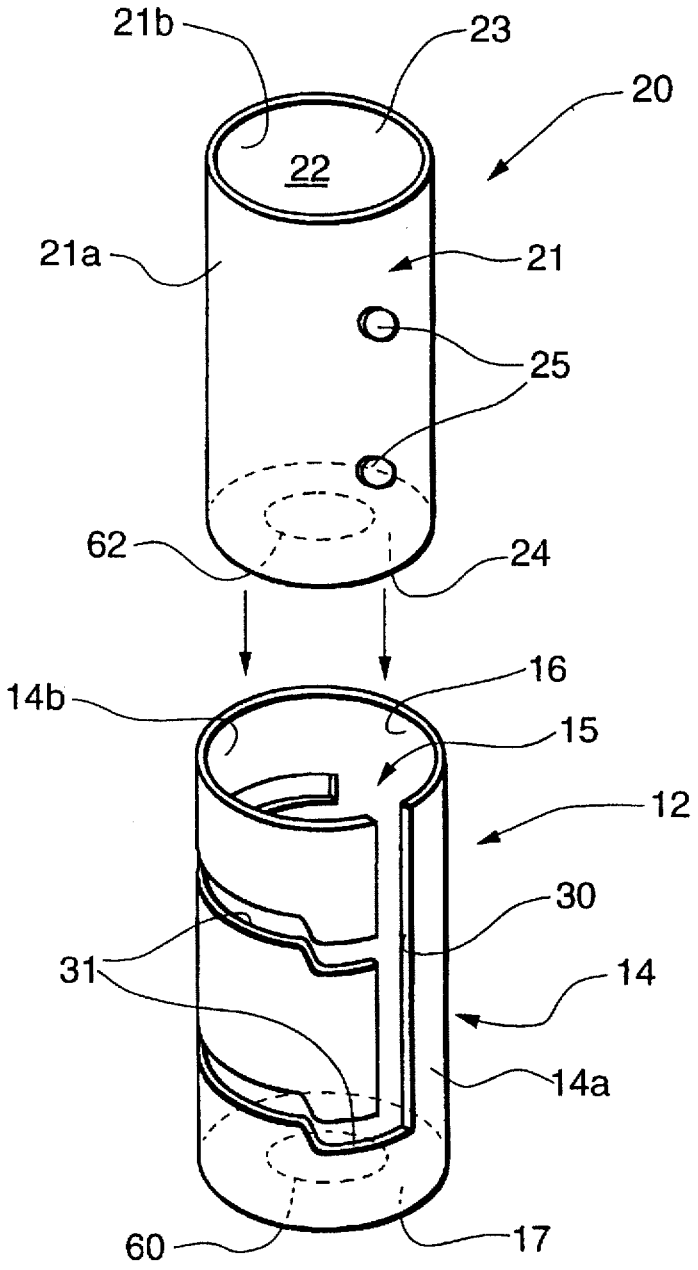
FIG. 6 is a schematic representation of an exploded view of a second alternate embodiment.

In the case of the above described ceramic core bowling balls, because the maximum distance a socket 52 can be drilled is only 2.5 inches, there is much less surface area on the outer surfaces of the inner and outer sleeves. As such, an alternate embodiment is disclosed, and is depicted in FIG. 6, in which inner sleeve 21 is provided with only two tips 25 instead of three. Consequently, outer sleeve 12 has only two lateral channels 31.

In a preferred embodiment, as shown in FIGS. 4A–E, there is a biasing means 40 provided preferably within the interior 16 of outer sleeve 12, upon which inner sleeve 20 rests when inserted in outer sleeve 12. Biasing means 40 preferably comprises a resilient synthetic material, but can comprise any other biasing means, such as a spring, or any object which is compressible and composed of a nonmetallic or, more preferably, a rubber or rubber-like material.

In a preferred embodiment, lateral channels 31 are offset as shown in FIGS. 1, 2 and 4. In particular, each lateral channel 31 extends from longitudinal channel 30 in a direction parallel to axis 13 to form a "lower tier." The "lower tier" extends for a distance around the perimeter of wall 14. At the end of the "lower tier", lateral channel 31 then extends upwards, towards the top 16 of sleeve 12, at an angle for a short distance. At the end of this short distance, lateral channel 31 again becomes parallel to axis 13 and extends for a distance to form an "upper tier." The "lower tier" preferably extends a distance ranging from 0.3 to 0.7 inches, and more preferably, 0.5 inches. The "upper tier" preferably extends a distance ranging from 0 to 2 inches, and more preferably, 1.5 inches. Although these distances are preferred, they can vary significantly depending upon how much rotation of inner sleeve 20 one desires. The angled portion preferably extends a distance which will allow the inner sleeve 20 to be biased upwards by the biasing means 40 until biasing means 40 is fully biased. This distance will vary drastically depending upon the angle at which the angled portion is formed. It is preferred that the angled portion be formed at an angle of 45°, although the degree of this angle is not critical to the invention.

The offset structure of the channels 31 allows the inner sleeve to be securely contained within outer sleeve 12 during use of the bowling ball and prevent accidental removal therefrom. In particular, inner sleeve 20 is securely held within outer sleeve 12 while retaining the capability of rotating laterally within outer sleeve 12 due to the biasing force of biasing means 40.

In an alternate embodiment, in order to comply with regulations set by the American Bowling Congress (ABC) and the Women's International Bowling Congress (WIBC), a portion is removed from the bottoms 17 and 24 of both the outer and inner sleeves to form holes 60 and 62 respectively. The holes 60, 62 are required so that the core of the ball 50 is accessible for testing. However, holes 60, 62 also serve a practical purpose in that they make it physically easier to insert and remove the inner sleeve from the outer sleeve. For example, with the holes 60, 62 present, no vacuum will form between the inner and outer sleeve when one attempts to remove inner sleeve 20 from outer sleeve 12.

Figure 5:
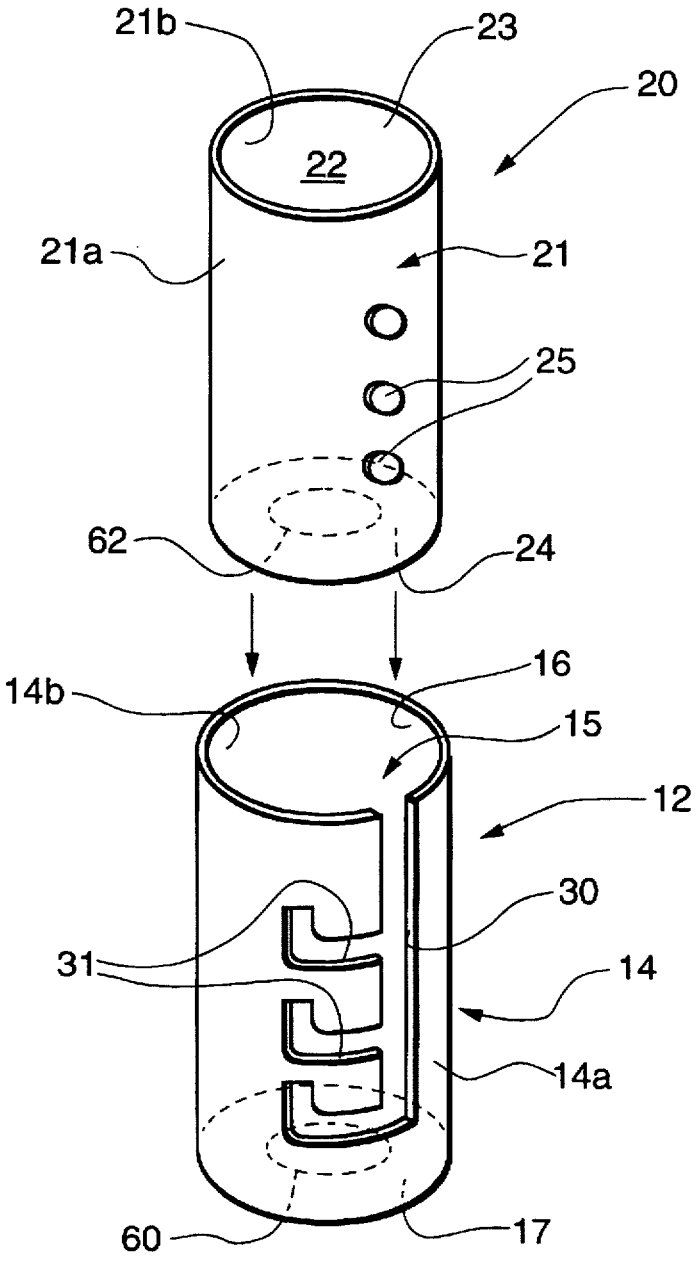
FIG. 5 is a schematic representation of an exploded view of a first alternate embodiment of the present device.

An alternate embodiment of the entire interchangeable insert is contemplated and shown in FIG. 5. In this embodiment, the inner sleeve 20 does not rotate within outer sleeve 12. All of the parts and their dimensions are the same as described above, except for the lateral channels 31. In this embodiment, as shown in FIG. 5, lateral channels 31 are still present, however, they only extend a very slight distance around the perimeter of wall 14. In fact, lateral channels 31 need only extend enough to provide a "lower tier" and an offset portion, both having the same dimensions as described above. An "upper tier" does not exist in this embodiment. In addition, it is preferred that the offset portion extend directly upward in a direction parallel to longitudinal channel 30 as shown in FIG. 5. The distance that the offset portion extends upward is preferably equal to the distance which biasing means 40 expands. Accordingly, this embodiment provides an interchangeable finger insert that does not allow the thumb to rotate with the inner sleeve 20 once inner sleeve 20 is completely inserted within the outer sleeve 12.

In operation of the rotatable embodiment, the outer sleeve 12 is already fixedly inserted in the bowling ball 50. The bowler must then choose an inner sleeve 20 having a diameter and length sized to fit his or her finger at that time. Once chosen, the tips 25 of the chosen inner sleeve 20 are aligned with longitudinal channel 30 and the inner sleeve 20 is inserted into sleeve 12 until it is resting on biasing means 40.

FIGS. 4 A–E show the preferred mode of fully inserting the inner sleeve into the outer sleeve. In particular, FIGS. 4 A–E show five positions of inner sleeve 20 within outer sleeve 12. FIG. 4A depicts inner sleeve 20 once it has been inserted into outer sleeve 12 as described above, and is resting on biasing means 40. In this position, tips 25 are not aligned with lateral channels 31. In order to align tips 25 with channels 31, pressure is applied to inner sleeve 20 as depicted by the arrows shown in FIG. 4B. Pressure must be applied until tips 25 are aligned with the "lower tier" of channels 31. Once tips 25 are aligned with the "lower tier" of lateral channels 31, while pressure is maintained, inner sleeve 20 is rotated so that tips 25 enter their respective channels 31 as shown in FIG. 4C.

Figure 4A:
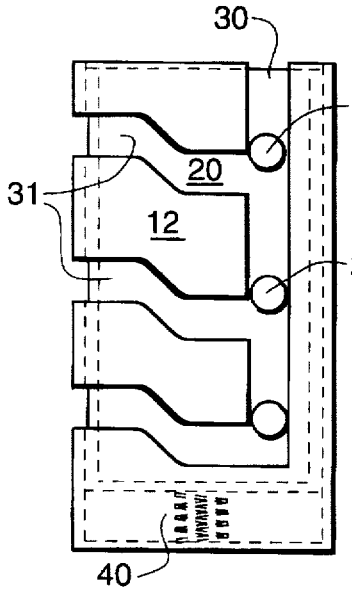
FIG. 4*a* shows one embodiment of the inner sleeve within the outer sleeve of the present device wherein the inner sleeve is resting on the biasing means.
Figure 4B:
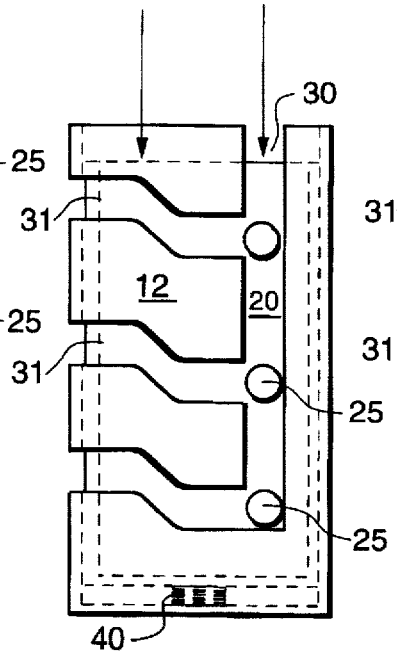
FIG. 4*b* shows one embodiment of the inner sleeve within the outer sleeve of the present device wherein the tips are aligned with the "lower tier" of the lateral channels.
Figure 4C:
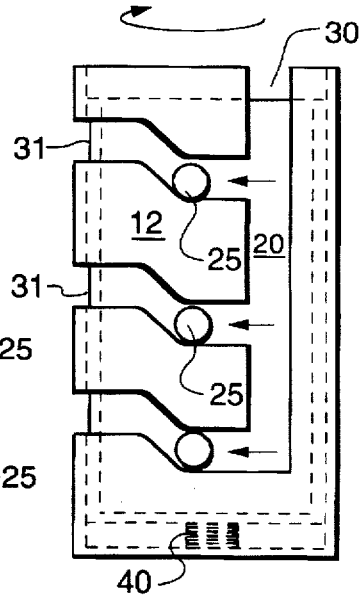
FIG. 4*c* shows one embodiment of the inner sleeve within the outer sleeve of the present device wherein the inner sleeve is rotated such that the tips enter their respective lateral channels.
Figure 4D:
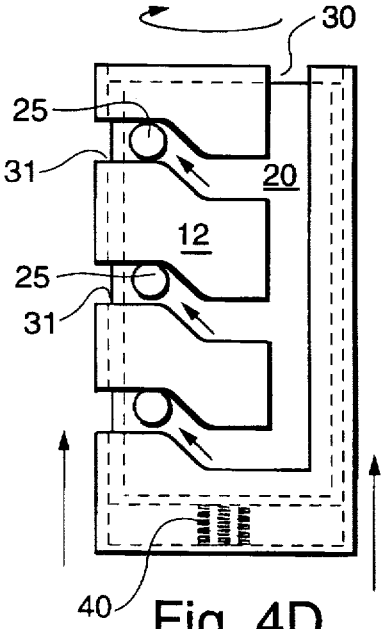
FIG. 4*d* shows one embodiment of the inner sleeve within the outer sleeve of the present device wherein the tips have moved through the offset portion to the "upper tier" of their respective lateral channels.

Once tips 25 have entered channels 31, inner sleeve 20 is further rotated in the same direction until tips 25 reach the offset portion of channels 31. At this point, as inner sleeve 20 is further rotated, the inner sleeve 20 will move upwards, as tips 25 move upwards through the offset portion due to the force provided by the biasing means 40. This action is shown in FIG. 4D.

Figure 4E:
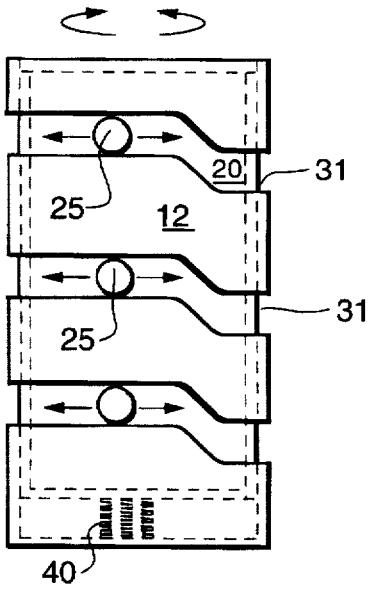
FIG. 4*e* shows one embodiment of the inner sleeve within the outer sleeve of the present device wherein the tips are within the "upper tier" of their respective lateral channels.

Once tips 25 have moved through the offset portion, tips 25 are positioned within the "upper tier" of lateral channels 31 and can now be moved laterally through the "upper tier" of channels 31 around the perimeter of wall 14 as far as lateral channels 31 extend as shown in FIG. 4E. Once in this position, inner sleeve 20 is now fully rotatably inserted within outer sleeve 12 in a secured fashion, and the insert is ready for use.

In order to remove inner sleeve 20, the tips 25 are rotated back towards longitudinal channel 12 until the offset position is reached. At this point, pressure is once again placed upon the top of inner sleeve 20 to force tips 25 down along the offset portion until the "lower tier" of lateral channels 31 is reached. Inner sleeve 20 is then rotated out of lateral channels 31 and into longitudinal channel 30. At this point, the inner sleeve 20 can be removed by pulling inner sleeve 20 out of outer sleeve 12 as tips 25 move along longitudinal channel 30.

Those skilled in the art having the benefit of the teachings of the present invention as hereinabove set forth, can effect numerous modifications thereto. These modifications are to be construed as being encompassed within the scope of the present invention as set forth in the appended claims.

I claim:

1. A finger insert for a bowling ball comprising:

an outer sleeve fixedly insertable in a socket within said bowling ball, said outer sleeve comprising a top, a bottom, a wall having an inner wall surface, an outer wall surface, a longitudinal channel grooved in the inner wall surface of the outer sleeve wall, extending from the top towards the bottom of the outer sleeve, and at least one lateral channel grooved in the inner wall surface of the outer sleeve wall, extending from the longitudinal channel for a predetermined distance; and an inner sleeve rotatably and removably mounted in said outer sleeve, said inner sleeve comprising a top, a bottom, a wall having an interior sized to contain a bowler's finger, and an outer wall surface having at least one tip extending therefrom and adapted to slidably ride within the longitudinal and lateral channels on the inner wall surface of the outer sleeve.

2. The insert of claim 1 wherein the outer sleeve comprises a plurality of lateral channels and the inner sleeve comprises a plurality of tips equaling in number the plurality of lateral channels in the outer sleeve.

3. The insert of claim 2 wherein each of the lateral channels extends approximately 270° around the wall of the outer sleeve.

4. The insert of claim 2 wherein the plurality of lateral channels comprise an upper tier and a lower tier, wherein the lower tier is connected to the upper tier and wherein the tips are adapted to continuously glide through both tiers.

5. The insert of claim 4 wherein the plurality of lateral channels further comprise an upwardly angled portion connecting the lower tier to the upper tier.

6. The insert of claim 2 wherein the outer wall surface of the outer sleeve wall has a diameter ranging from 1.0 to 1.75 inches.

7. The insert of claim 2 wherein the inner wall surface of the outer sleeve wall has a diameter ranging from 0.75 to 1.5 inches.

8. The insert of claim 2 wherein the outer wall surface of the inner sleeve wall has a diameter ranging from 0.75 to 1.75 inches.

9. The insert of claim 2 wherein the inner wall surface of the inner sleeve wall has a diameter ranging from 0.5 to 1.5 inches.

10. The insert of claim 2 further comprising three lateral channels and three tips.

11. The insert of claim 2 further comprising two lateral channels and two tips.

12. The insert of claim 1 wherein the tip of the inner sleeve extends a distance equal to or less than the thickness of the wall of the outer sleeve.

13. The insert of claim 1 further comprising a biasing means disposed within the outer sleeve between the bottom of the inner sleeve and the bottom of the outer sleeve.

14. The insert of claim 2 wherein the bottom of the outer sleeve and the bottom of the inner sleeve each have a portion removed defining a hole.

15. The insert of claim 1 wherein the inner wall surface of the outer sleeve defines a hollow cylindrical interior and wherein the outer wall surface of the inner sleeve has a cylindrical shape.

16. The insert of claim 15 wherein the outer wall surface of the inner sleeve defines an outer diameter, said outer diameter being smaller than the cylindrical interior of the outer sleeve.

17. A finger insert for a bowling ball comprising:

an outer sleeve fixedly insertable in a socket within said bowling ball, said outer sleeve comprising a top, a bottom, a wall having an inner wall surface, an outer wall surface, a longitudinal channel grooved in the inner wall surface of the outer sleeve wall, extending from the top towards the bottom of the outer sleeve, and at least one lateral channel grooved in the inner wall surface of the outer sleeve wall, extending from the longitudinal channel for a predetermined distance; and an inner sleeve rotatably mounted in said outer sleeve, said inner sleeve comprising a top, a bottom, a wall having an interior sized to contain a bowler's finger, and an outer wall surface having at least one tip extending therefrom and adapted to slidably ride within the longitudinal and lateral channels on the inner wall surface of the outer sleeve.

18. The insert of claim 17 wherein the lateral channel extends perpendicular to the longitudinal groove for a predetermined distance then extends parallel to the longitudinal groove for a predetermined distance in the direction of the top of the outer sleeve to form an L-shape.

* * * * *